United States Patent [19]

Feathers

[11] 4,377,163

[45] Mar. 22, 1983

[54] BREATHING APPARATUS

[75] Inventor: Leonard J. Feathers, Henfield, England

[73] Assignee: Chubb Panorama Limited, Sussex, England

[21] Appl. No.: 211,971

[22] Filed: Dec. 1, 1980

[30] Foreign Application Priority Data

Nov. 30, 1979 [GB] United Kingdom ..... 7941338

[51] Int. Cl.[3] ..... A62B 7/00

[52] U.S. Cl. ..... 128/205.22; 128/205.24; 128/201.28; 224/207; 224/209; 224/211; 248/312; 137/376; 169/62; 169/65; 222/180

[58] Field of Search ..... 128/204.18, 204.26, 128/204.27, 204.28, 205.12, 205.22, 205.24, 201.27, 201.28; 224/205, 206, 207, 208, 209, 210, 211, 257, 258, 264, 253; 248/312; 137/376; 169/51, 62, 65; 222/180

[56] References Cited

U.S. PATENT DOCUMENTS

| | | | |
|---|---|---|---|
| 1,210,102 | 12/1916 | Riggins | 248/312 |
| 1,589,463 | 6/1926 | Drager | 128/205.22 |
| 2,854,001 | 9/1958 | Humblet | 128/205.22 |
| 3,229,858 | 1/1966 | Lesh | 222/180 |
| 4,250,876 | 2/1981 | Kranz | 128/204.18 |

*Primary Examiner*—Henry J. Recla

*Attorney, Agent, or Firm*—Pollock, Vande Sande & Priddy

[57] ABSTRACT

A breathing apparatus comprises a cylinder assembly supported by a harness through a mounting bracket. The bracket has a leg with an open-ended slot into which a grooved portion of the cylinder assembly is passed. The assembly is secured by screwing a pressure-reducing valve onto the shut-off valve of the cylinder assembly, in so doing a knurled ring on the pressure-reducing valve coming into position adjacent to an edge of the bracket to prevent subsequent withdrawal of the cylinder assembly from the slot.

11 Claims, 5 Drawing Figures

BREATHING APPARATUS

The present invention relates to self-contained breathing apparatus such as may be worn e.g. by firemen, rescue workers and the like who are required to perform tasks in noxious or oxygen-depleted environments, or by divers. Known apparatus of this type usually comprises a harness supporting a cylinder of compressed air or other pressurised breathing gas; a facemask, mouthpiece or the like breathing interface means; and means for supplying gas from the cylinder to the interface means at a pressure and rate such as to permit comfortable respiration by the user. The latter may comprise a first stage pressure-reducing valve and a second stage lung-controlled or demand valve to admit gas to the interface means in response to inspiration by the user.

It is a desirable characteristic of such apparatus for the cylinder assembly to be mountable to, and demountable from, the rest of the apparatus in a quick and simple manner, to facilitate the task of removing a spent cylinder from the apparatus and replacing it with a full one. There is a need to be able to separate the cylinder assembly not only from the rest of the breathing circuit but from the harness as well, in order that a spent cylinder can be sent for refilling. Furthermore, there may be occasions when a rescue worker or the like needs to change from one cylinder to another during actual use of the apparatus, and clearly it is desirable for this to be accomplished as simply and speedily as possible and without the user being required to doff his harness. It is an aim of the invention, therefore, to provide a means whereby these objectives can be realised, more particularly through the use of simple and low-cost components, without requiring any major modification of conventional cylinder assemblies, and without compromising the security of the cylinder assembly when mounted to the harness.

Throughout this specification, the term "cylinder assembly" is used to denote a cylinder shell or other vessel intended to act as a reservoir for pressurised breathing gas together with any separately-manufactured components which are normally retained as permanent fixtures of the vessel - such as a shut-off valve and/or a pressure gauge.

In a first aspect the invention resides in breathing apparatus including a cylinder assembly; a harness for supporting the cylinder assembly through a mounting member secured to the harness; and fastening means co-operable with the cylinder assembly; said mounting member and the cylinder assembly having complementary formations comprising respectively a planar portion with an open-ended slot and an externally grooved portion, whereby said formations can be engaged by inserting said grooved portion into said slot with opposing flanks of the grooved portion lying on opposite faces of said planar portion; and said fastening means being operable to resist the withdrawal of said grooved portion from said slot when engaged as aforesaid.

The fastening means may be effective to resist the withdrawal of the grooved portion from the slot by abutment with an edge of said planar portion located remote from the open end of the slot.

In a particularly preferred embodiment, the fastening means comprises part of a first stage pressure-reducing valve which is connected thereby to the cylinder assembly when the whole apparatus is assembled—the same fastening means thus serving both to connect the cylinder assembly into the breathing circuit (of which the pressure-reducing valve is a serial part) and to complete the physical securement of the cylinder assembly to the harness. In apparatus which does not require the use of a first stage pressure-reducing valve, the fastening means can be part of a hose connector which similarly serves to connect the cylinder assembly into the breathing circuit.

The aforesaid grooved portion is preferably in the vicinity of a neck of the cylinder assembly, and may be provided e.g. in a spigot by which a shut-off valve is connected to a cylinder shell of that assembly.

In one class of embodiments, the cylinder assembly is arranged to be supported by being hung from a waist belt portion of the harness. Such an arrangement is particularly suitable when using a gas reservoir of a capacity which is somewhat less than that which demands that the vessel be carried on the back of the user, and thus is especially applicable to the type of industrial breathing apparatus commonly referred to as an "escape set". In such an embodiment the aforesaid mounting member may be in the form of a generally L-shaped, plate-like bracket, one leg of which is arranged to lie generally horizontally in use and constitutes the aforesaid planar portion with an open-ended slot, and the other leg of which is arranged to lie generally vertically in use and is provided e.g. with a pair of generally vertical, parallel slots by which it can be threaded onto the waist belt, or is otherwise adapted for securement thereto. The harness may further comprise a shoulder strap, in which case the vertical leg of the bracket may also have e.g. a pair of generally horizontal, parallel slots or be otherwise adapted so as to provide a means of interlinking the should strap and waist belt.

In a second aspect the invention resides in a bracket as defined above, per se.

However, the invention is not restricted to a waist-hung arrangement as described above and, specifically, embodiments comprising a harness arranged to support the cylinder assembly on the back of the user are proposed.

The invention will now be more particularly described, by way of example, with reference to the accompanying drawings, in which.

Figure 1:
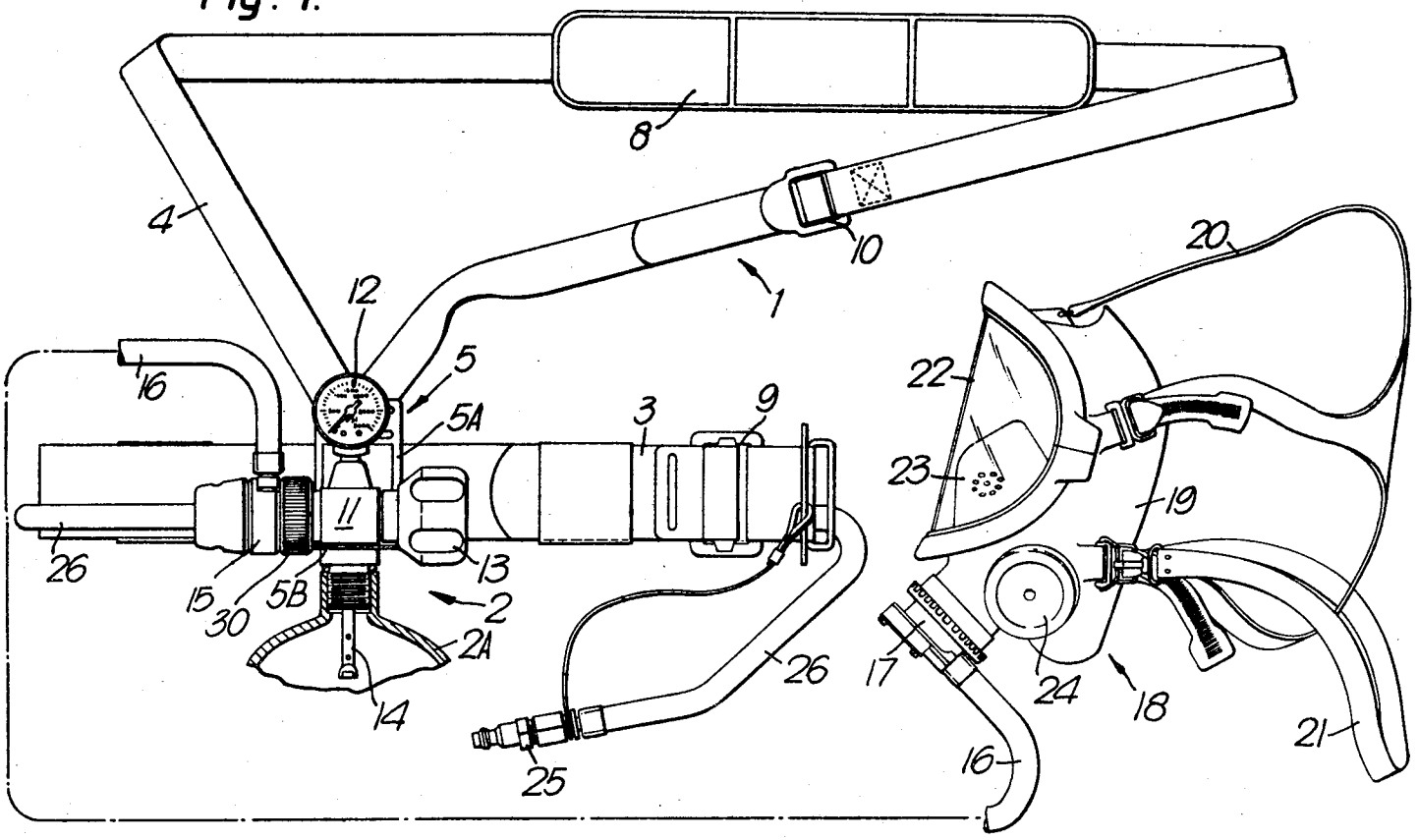
FIG. 1 illustrates the general arrangement of a first embodiment of breathing apparatus in accordance with the invention.

Referring to FIG. 1, this illustrates breathing apparatus in the form of a so-called escape set, comprising a harness 1 by which a compressed air cylinder assembly 2 is supported. The harness comprises a waist belt 3 and a single shoulder strap 4. Coupled to the waist belt is an L-shaped, plate-like bracket 5 which provides a mounting by which the cylinder assembly 2 can be hung from the belt as is more fully described hereinafter. The coupling of the bracket to the belt is achieved by threading the belt through a pair of vertical slots 6 in the upright leg 5A of the bracket (as more clearly seen in FIGS. 2 and 3) and, in the illustrated embodiment, the intention is for the position of the bracket on the belt to be adjusted so as to lie in the region of the user's right hip when the harness is donned. The shoulder strap 4 is also coupled to the bracket, as more clearly seen in FIG. 2, by being threaded through a pair of horizontal slots 7 located above the slots 6 in bracket leg 5A, when the harness is donned the strap extending from the hip position diagonally across the wearer's chest and back and over his opposite shoulder, at which position a cushioning pad 8 is provided. The waist belt and shoulder strap are provided with respective slide adjusters 9 and 10 whereby the fit of the harness can be adjusted to suit the wearer.

The cylinder assembly 2 comprises a shell 2A (of which only the top portion is shown) provided with a shut-off valve 11 and a pressure gauge 12. When the user requires to breathe from the cylinder the valve 11 is opened by means of its handwheel 13 to permit air to flow through an off-take tube 14 to a first stage pressure-reducing valve 15. From here the air is supplied at a substantially constant pressure through a flexible hose 16 to a demand valve 17 mounted on the user's facemask 18. As illustrated, the mask 18 comprises an elastomeric facepiece 19, head harness 20, neck strap 21, visor 22, inner mask 23 and speech diaphragm 24. In addition an exhalation valve (not shown) is mounted at the position on the right hand side of the mask corresponding to that of the speech diaphragm 24 on the left. The valve 17, which acts to admit air to the facemask to satisfy the breathing need in response to inspiration by the user, is advantageously of the type described in our copending United Kingdom patent application No. 8020307.

Optionally, the set may include an airline connector 25 which can be coupled to a line (not shown) leading from a regulated, external air supply. When operating from an external supply the cylinder valve 11 will be kept closed, with the cylinder contents being held in reserve for use only in the event of an emergency. The connector 25 is provided at the end of a flexible hose 26 which extends around the waist belt 3 and is connected at its other end into the body of the pressure-reducing valve 15 (see FIG. 3). Since the connector 25 is intended to be used with a supply of air which is already at a respirable pressure, however, the connection of tube 26 into the valve 15 is made at a point downstream of its working parts, so that the air supplied through tube 26 is led directly through the valve body into the facemask supply hose 16.

Figure 2:
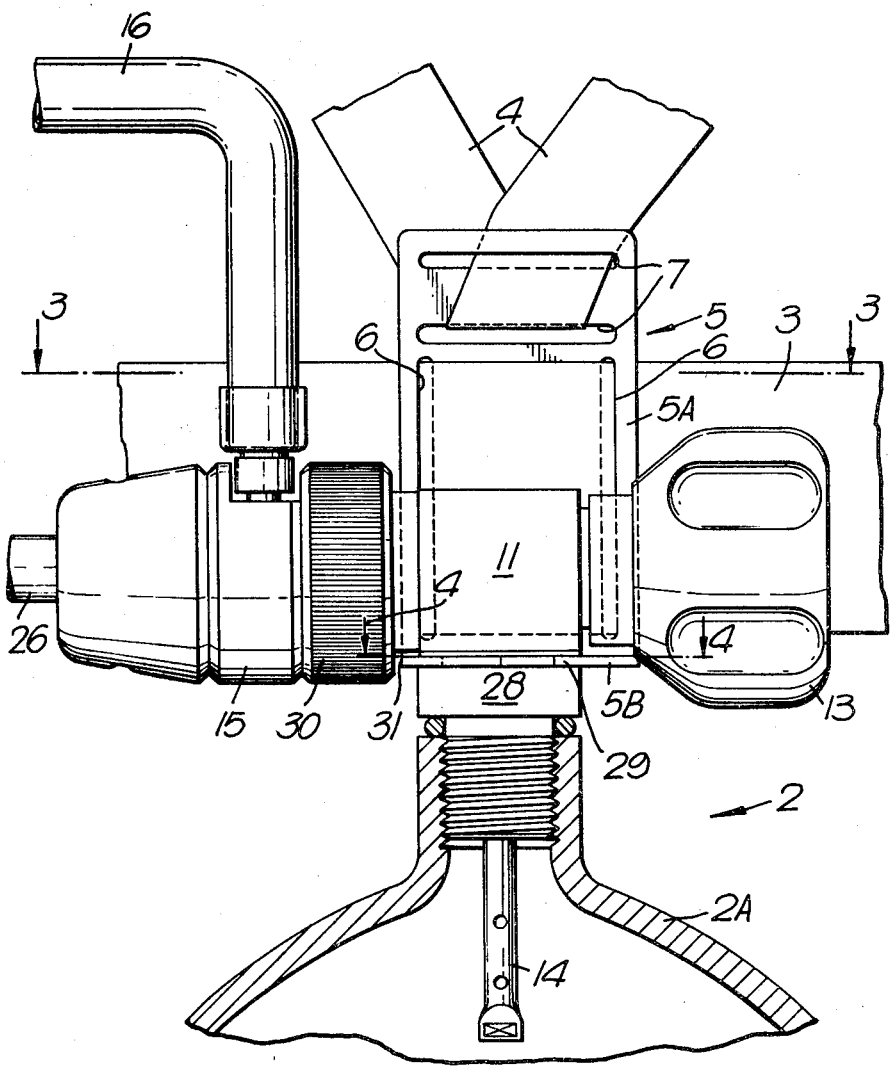
FIG. 2 shows, to an enlarged scale, a portion of the apparatus of FIG. 1 with the pressure gauge omitted.
Figure 3:
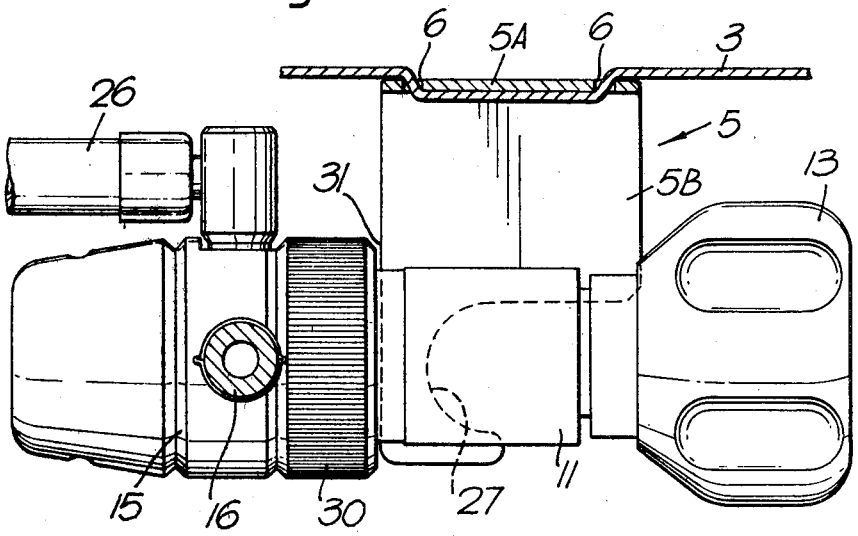
FIG. 3 is a section on the line 3—3 of FIG. 2.
Figure 4:
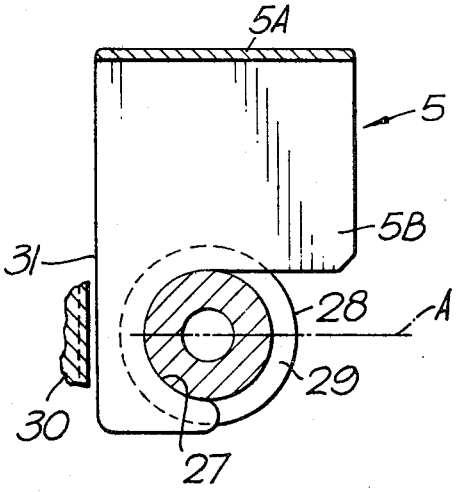
FIG. 4 is a section on the line 4—4 of FIG. 2.

With reference to FIGS. 2–4, description will now be directed to the means by which the cylinder assembly 2 is mounted to the harness 1.

As indicated in FIGS. 3 and 4, the horizontal leg 5B of the bracket 5 is configured so as to define an open-ended slot 27 with an arcuate base. In the assembled apparatus, the plane of the bracket leg 5B is at right angles to the axis of the shell 2A, the longitudinal axis A of the slot 27 is parallel to that of the shut-off valve 11/pressure-reducing valve 15 assembly, and the open end of the slot is remote from the pressure-reducing valve. As shown in FIG. 2, the shut-off valve 11 is secured to the shell 2A by means of a screw-threaded spigot 28 which is formed with an external annular groove 29 centred on the shell axis. The radius of the internal margin of this groove corresponds with the radius of the arcuate base of the bracket slot 27, and the axial width of the groove corresponds with the thickness of the bracket leg 5B. With the pressure-reducing valve 15 disconnected from the shut-off valve 11, therefore, the cylinder assembly can be coupled to the bracket 5 by passing the grooved portion of the spigot 28 into the slot 27. In this condition, the cylinder assembly is prevented from being displaced upwards or downwards relative to the bracket 5, or from being tilted relative thereto, by the engagement of the corresponding portion of the bracket leg 5B between the opposing flanks of the groove 29 (see FIGS. 2 and 4). In this condition, the only way in which the cylinder assembly can disconnect from the bracket is through a movement tending to withdraw the spigot 28 horizontally along axis A through the open end of the slot 27.

As shown in FIGS. 2 and 3, the pressure-reducing valve 15 is connected to the shut-off valve 11 by means of a knurled, internally screwthreaded ring 30, which is captive on the pressure-reducing valve 15 and mates with a corresponding external screwthread on the shut-off valve 11. If the cylinder assembly including the shut-off valve 11 is coupled to the bracket 5 as indicated above and the pressure-reducing valve 15 is then connected to the shut-off valve, it will be seen that the ring 30 is brought into a position adjacent to the edge 31 of the bracket leg 5A remote from the open end of the slot 27. In this condition, any movement tending to withdraw the spigot 28 from the slot 27 is resisted by the abutment of the ring 30 with the bracket edge 31.

It will thus be appreciated that a single fastening means, in the form of the ring 30, is effective both to make the connection of the cylinder assembly 2 into the breathing circuit, and to complete the physical securement of that assembly to the harness 1. Furthermore, by providing a mounting arrangement as described above, it will be appreciated that a cylinder with its associated shut-off valve and pressure gauge can very quickly and easily be mounted to or removed from the remainder of the set, thereby greatly facilitating the replacement of a spent cylinder with a full one during use (and without the user having to doff his harness), and the removal for refilling and subsequent refitting of a cylinder between uses.

Figure 5:
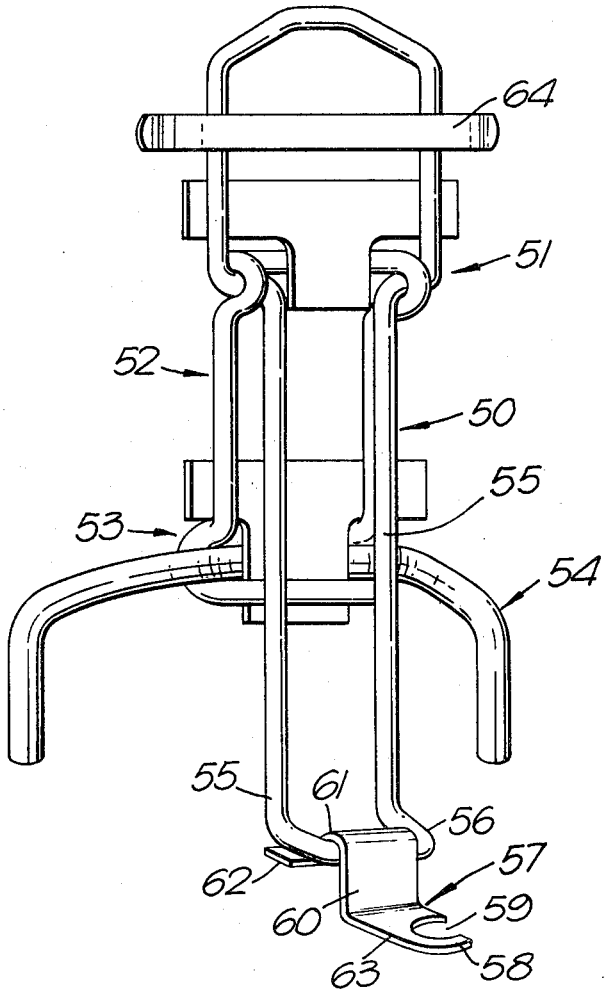
FIG. 5 illustrates the "skeleton" of the harness of a second embodiment of the invention.

Turning now to FIG. 5, this illustrates the "skeleton" of a double-hinged back-carrying harness assembly of the type shown in FIG. 18 of our copending United Kingdom patent application No. 8029300. The structure of this harness assembly is fully described in the aforesaid application, but briefly comprises a wire-work cylinder carrier 50 hinged at 51 to a back frame 52, the latter in turn being hinged at 53 to the frame 54 of a pelvic girdle. In the fully assembled harness straps (not shown) extend from the top of the carrier 50 over the user's shoulders and down to a cradle (not shown) of webbing or the like material secured to the frame 54. The carrier 50 is adapted to support a compressed air cylinder assembly (not shown) in the conventional inverted, upright attitude on the user's back, and includes a pair of parallel rails 55 extending downwardly from the hinge 51, which turn rearwardly (in the sense in which the harness is worn) at their lower ends to join in a U-shaped portion 56 to which a cylinder mounting bracket 57 is welded.

The bracket 57 is formed from metal plate and includes an L-shaped portion the horizontal leg 58 of which is configured so as to define an open-ended slot 59 with an arcuate base. This leg is joined by an upright leg 60 to a hooked portion 61 which engages over the base of the U-shaped portion 56 of the cylinder carrier 50 joining its rails 55. From the opposite side of the hooked portion 61 there extend a pair of lateral tongues 62 (of which only one is seen in FIG. 5) which engage beneath, and are welded to, respective limbs of the said U-shaped portion. Through this simple means of fixation the downward loading of a cylinder assembly on bracket 57 is transferred to the carrier 50.

The cylinder assembly and associated breathing circuit to be used with this embodiment is generally similar to that described above in relation to the embodiment of FIGS. 1 to 4, although cylinders of greater capacity may be used with the back-carrying harness. The manner in which the cylinder assembly is secured to the bracket leg 58 in FIG. 5 is also similar to the mounting of the cylinder assembly to the leg 5B in the previously-described embodiment, except that the cylinder assembly is in an inverted position—i.e. with the pressure-reducing valve disconnected an externally grooved portion in the vicinity of the cylinder neck is passed into the slot 59 and its securement is completed, along with the connection of the cylinder assembly into the breathing circuit, by screwing the pressure-reducing valve onto the shut-off valve, this bringing the knurled ring of the pressure-reducing valve into a position adjacent to the edge 63 of the bracket.

In the embodiment of FIG. 5 a band 64 is connected to the carrier 50 to pass around the body of the cylinder and constrain it against the upper end of the carrier. By virtue of the secure mounting provided by bracket 57, however, this band need engage the cylinder only to the extent necessary to prevent its upper end from tilting away from the carrier and need not be arranged to embrace the cylinder with the same degree of force as in some prior art breathing apparatus where a cylinder band is provided as the only, or the main, means of transferring the weight of the cylinder assembly to a harness.

I claim:

1. Breathing apparatus including a cylinder assembly; means defining a breathing circuit connected to the cylinder assembly to lead breathing gas from said assembly to a user; a harness; a mounting member secured to the harness through which the cylinder assembly is supported; and fastening means co-operable with the cylinder assembly; said mounting member and the cylinder assembly having complementary formations comprising respectively a planar portion with an open-ended slot and an externally grooved portion, whereby said formations can be engaged by inserting said grooved portion into said slot with opposing flanks of the grooved portion lying on opposite faces of said planar portion; said fastening means including means to resist the withdrawal of said grooved portion from said slot when engaged as aforesaid while simultanously comprising means to connect the breathing circuit to the cylinder assembly as aforesaid.

2. Breathing apparatus according to claim 1 wherein the breathing circuit includes a pressure-reducing valve and said pressure-reducing valve includes said fastening means.

3. Breathing apparatus according to claim 1 wherein the cylinder assembly includes a neck and said grooved portion is in the vicinity of said neck.

4. Breathing apparatus according to claim 3 wherein the cylinder assembly includes a cylinder shell and a shut-off valve having a spigot by which the shut-off valve is connected to the shell, and said grooved portion is provided in said spigot.

5. Breathing apparatus according to claim 1 wherein the harness includes a waist belt portion and the cylinder assembly is supported by being hung from said waist belt portion.

6. Breathing apparatus according to claim 5 wherein said mounting member comprises a generally L-shaped, plate-like bracket one leg of which is arranged to lie generally horizontally in use and constitutes said planar portion with an open-ended slot, and the other leg of which is arranged to lie generally vertically in use and is adapted for securement to said waist belt portion of the harness.

7. Breathing apparatus according to claim 6 wherein the harness further includes a shoulder strap portion and both said waist belt portion and said shoulder strap portion are secured independently to said other leg of the bracket.

8. Breathing apparatus according to claim 1 wherein the harness is arranged to support the cylinder assembly on the back of the user.

9. Breathing apparatus according to claim 8 wherein the harness includes a carrier for the cylinder arranged to lie along the back of the user, the carrier having at its lower end a rearwardly-directed plate-like leg constituting said planar portion with an open-ended slot.

10. Breathing apparatus including a cylinder assembly; means defining a breathing circuit connected to the cylinder assembly to lead breathing gas from said assembly to a user; a harness; a mounting member secured to the harness through which the cylinder assembly is supported; and fastening means co-operable with the cylinder assembly; said mounting member and the cylinder assembly having complementary formations comprising respectively a planar portion having opposing edges with an open-ended slot extending from one said edge, and an externally grooved portion, whereby said formations can be engaged by inserting said grooved portion into said slot with opposing flanks of the grooved portion lying on opposite faces of said planar portion; said fastening means including means to abut the edge of said planar portion which is opposite to said one edge thereby to resist the withdrawal of said grooved portion from said slot when engaged as aforesaid.

11. Breathing apparatus including a cylinder assembly; means defining a breathing circuit connected to the cylinder assembly to lead breathing gas from said assembly to a user; a harness including a waist belt portion and a shoulder strap portion; a mounting member secured to the harness through which the cylinder assembly is supported; and fastening means co-operable with the cylinder assembly; said mounting member comprising a generally L-shaped, plate-like bracket; one leg of said bracket being arranged to lie generally horizontally in use and having an open-ended slot; the cylinder assembly having an externally grooved portion complementary to said slot which can be engaged with said slot by insertion therein with opposing flanks of the grooved portion lying on opposite faces of said one leg of the bracket; said fastening means including means to resist the withdrawal of said grooved portion from said slot when engaged as aforesaid while simultaneously comprising means to connect the breathing circuit to the cylinder assembly as aforesaid; the other leg of said bracket being arranged to lie generally vertically in use and said waist belt portion and said shoulder strap portion of the harness being secured independently thereto.

* * * * *